US008636055B2

(12) United States Patent
Young et al.

(10) Patent No.: US 8,636,055 B2
(45) Date of Patent: Jan. 28, 2014

(54) CONTROLLED APERTURE BALL DROP

(75) Inventors: Joel H. Young, Norman, OK (US); Ronald B. Beason, Wanette, OK (US); Nicholas J. Cannon, Washington, OK (US); Bob McGuire, Meridian, OK (US); Danny Lee Artherholt, Asher, OK (US)

(73) Assignee: Oil States Energy Services, L.L.C., Houston, TX (US)

( * ) Notice: Subject to any disclaimer, the term of this patent is extended or adjusted under 35 U.S.C. 154(b) by 351 days.

(21) Appl. No.: 13/101,805

(22) Filed: May 5, 2011

(65) Prior Publication Data

US 2012/0279717 A1 Nov. 8, 2012

(51) Int. Cl.
*E21B 33/068* (2006.01)

(52) U.S. Cl.
USPC ..... 166/75.15; 166/70; 15/104.062

(58) Field of Classification Search
USPC ..... 166/70, 75.15; 15/104.062
See application file for complete search history.

(56) References Cited

U.S. PATENT DOCUMENTS

| | | | | |
|---|---|---|---|---|
| 2,961,045 | A | | 11/1960 | Stonger et al. |
| 2,961,046 | A | | 11/1960 | Moeller et al. |
| 3,779,270 | A | * | 12/1973 | Davis ..... 137/268 |
| 3,889,708 | A | | 6/1975 | Chronister et al. |
| 4,111,334 | A | | 9/1978 | Winn, Jr. et al. |
| 4,132,243 | A | * | 1/1979 | Kuus ..... 137/268 |
| 4,268,932 | A | | 5/1981 | Hogan |
| 4,359,797 | A | | 11/1982 | Banks |
| 6,302,199 | B1 | | 10/2001 | Hawkins et al. |
| 6,575,238 | B1 | | 6/2003 | Yokley |
| 2003/0155114 | A1 | | 8/2003 | Pedersen et al. |
| 2005/0039925 | A1 | | 2/2005 | Connell |
| 2007/0068679 | A1 | | 3/2007 | Robichaux et al. |
| 2008/0087414 | A1 | | 4/2008 | Robichaux et al. |
| 2008/0223587 | A1 | | 9/2008 | Cherewyk |
| 2010/0200222 | A1 | * | 8/2010 | Robichaux et al. ..... 166/250.01 |
| 2010/0288496 | A1 | | 11/2010 | Cherewyk |

FOREIGN PATENT DOCUMENTS

CN 201650255 U 11/2010

* cited by examiner

*Primary Examiner* — Giovanna Wright
(74) *Attorney, Agent, or Firm* — Nelson Mullins Riley & Scarborough, LLP

(57) ABSTRACT

A controlled aperture ball drop includes a ball cartridge that is mounted to a frac head or a high pressure fluid conduit. The ball cartridge houses a ball rail having a bottom end that forms an aperture with an inner periphery of the ball cartridge through which frac balls of a frac ball stack supported by the ball rail are sequentially dropped from the frac ball stack as a size of the aperture is increased by an aperture controller operatively connected to the ball rail.

20 Claims, 12 Drawing Sheets

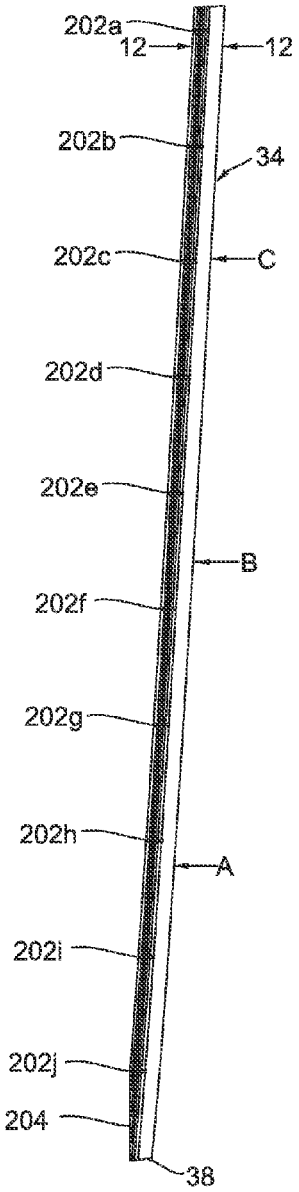
FIG. 11
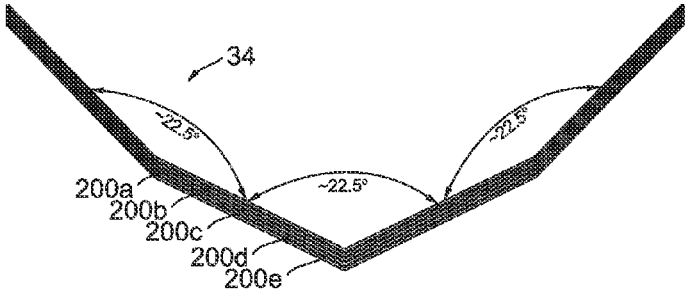
FIG. 12
| Rail Deflection Under 10 lb. Mass | | | |
|---|---|---|---|
| Position | (A) 17.75" | (B) 35.50" | (C) 53.25" |
| Deflection | 0.040" | 0.060" | 0.045" |
FIG. 13

CONTROLLED APERTURE BALL DROP

RELATED APPLICATIONS

This is the first application filed for this invention.

FIELD OF THE INVENTION

This invention relates in general to equipment used for the purpose of well completion, re-completion or workover, and, in particular, to equipment used to drop frac balls into a fluid stream pumped into a subterranean well during well completion, re-completion or workover operations.

BACKGROUND OF THE INVENTION

The use of frac balls to control fluid flow in a subterranean well is known, but of emerging importance in well completion operations. The frac balls are generally dropped or injected into a well stimulation fluid stream being pumped into the well. This can be accomplished manually, but the manual process is time consuming and requires that workmen be in close proximity to highly pressurized frac fluid lines, which is a safety hazard. Consequently, frac ball drops and frac ball injectors have been invented to permit faster and safer operation.

Multi-stage well stimulation operations often require that frac balls be sequentially pumped into the well in a predetermined size order that is graduated from a smallest to a largest frac ball. Although there are frac ball injectors that can be used to accomplish this, they operate on a principle of selecting one of several injectors at the proper time to inject the right ball into the well when required. A frac ball can therefore be dropped out of the proper sequence, which has undesired consequences.

There therefore exists a need for a controlled aperture ball drop for use during well completion, re-completion or workover operations to substantially eliminate the possibility of dropping a frac ball into a subterranean well out of sequence.

SUMMARY OF THE INVENTION

It is therefore an object of the invention to provide a controlled aperture ball drop for use during multi-stage well completion, re-completion or workover operations.

The invention therefore provides a controlled aperture ball drop, including a ball cartridge having a sealed top end and a bottom end adapted to be connected to a frac head or a high pressure fluid conduit; a ball rail within the ball cartridge, the ball rail having a bottom end that forms an aperture with an inner periphery of the ball cartridge and supports a frac ball stack against the inner periphery of the ball cartridge above the aperture; and an aperture controller operatively connected to the ball rail in the ball cartridge, the aperture controller controlling a size of the aperture to sequentially release frac balls from the frac ball stack.

The invention further provides a controlled aperture ball drop, including a ball rail within a ball cartridge, the ball rail having a bottom end that forms an aperture with an inner periphery of the ball cartridge and supports a frac ball stack against the inner periphery of the ball cartridge above the aperture; and an aperture controller operatively connected to the ball rail, the aperture controller controlling a size of the aperture to sequentially drop frac balls in sequence from the frac ball stack.

The invention yet further provides a controlled aperture ball drop, comprising a ball rail supported within a ball cartridge that is adapted to be mounted to a frac head or a high pressure fluid conduit, a bottom end of the ball rail forming an aperture with an inner periphery of the ball cartridge through which frac balls of a frac ball stack supported by the ball rail are sequentially dropped as a size of the aperture is increased by an aperture controller operatively connected to the ball rail.

BRIEF DESCRIPTION OF THE DRAWINGS

Having thus generally described the nature of the invention, reference will now be made to the accompanying drawings, in which:

FIG. 11 is a side elevational view of one embodiment of a ball rail for the embodiments of the invention shown in FIGS. 1-10;

FIG. 12 is a schematic cross-sectional view of the ball rail shown in FIG. 11, taken at lines 12-12 of FIG. 11;

FIG. 13 is a table showing a deflection of the ball rail shown in FIG. 11 at points A, B and C under a 10 lb. (4.54 kg) mass;

DETAILED DESCRIPTION OF THE PREFERRED EMBODIMENTS

The invention provides a controlled aperture ball drop adapted to drop a series of frac balls arranged in a predetermined size sequence into a fluid stream being pumped into a subterranean well. The frac balls are stored in a large capacity ball cartridge of the ball drop, which ensures that an adequate supply of frac balls is available for complex well completion projects. The frac balls are aligned in the predetermined size sequence and kept in that sequence by a ball rail supported within the ball cartridge by an aperture control arm. An aperture controller moves the aperture control arm in response to a drop ball command to release a next one of the frac balls in the frac ball sequence into the fluid stream being pumped into the subterranean well. In one embodiment, the ball drop includes equipment to detect a ball drop and confirm that a ball has been released from the ball cartridge.

Figure 1:
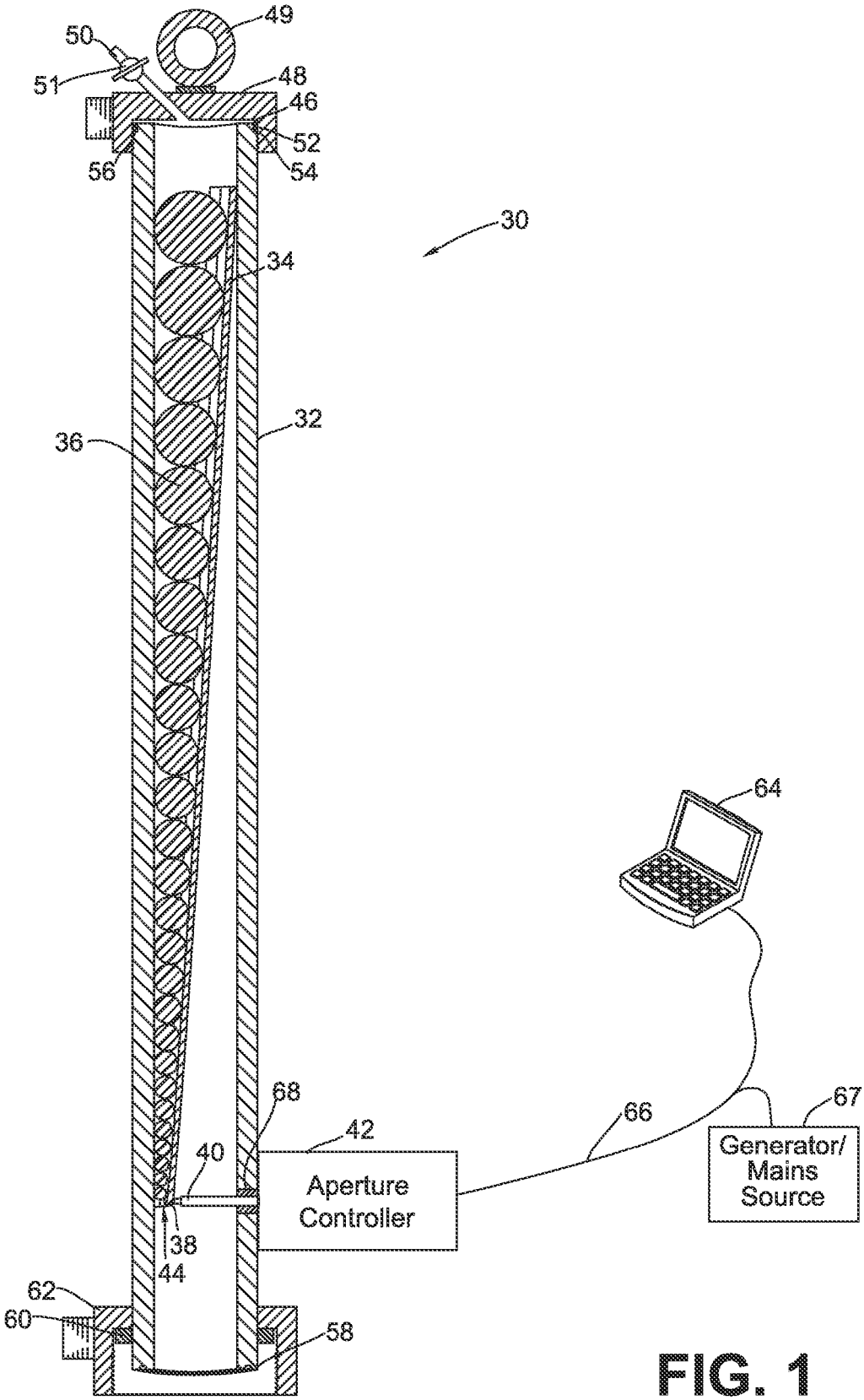
FIG. 1 is a schematic cross-sectional view of one embodiment of the controlled aperture ball drop in accordance with the invention.

FIG. 1 is a schematic cross-sectional view of one embodiment of a controlled aperture ball drop 30 in accordance with the invention. A cylindrical ball cartridge 32 accommodates a ball rail 34 that supports a plurality of frac balls 36 arranged in a predetermined size sequence in which the frac balls are to be dropped from the ball drop 30. In one embodiment, the ball cartridge 32 is made of a copper beryllium alloy, which is nonmagnetic and has a very high tensile strength. However, the ball cartridge 32 may also be made of stainless steel, provided the material used has enough tensile strength to contain fluid pressures that will be used to inject stimulation fluid into the well (generally, up to around 20,000 psi). The ball rail 34 is supported at a bottom end 38 by an aperture control arm 40 that extends through a port in a sidewall of the ball cartridge 32 and is operatively connected to an aperture controller 42. The aperture controller 42 incrementally moves the aperture control arm 40 to control a size of a ball drop aperture 44 between an inner periphery of the ball cartridge 32 and the bottom end 38 of the ball rail 34. Exemplary embodiments of the aperture controller 42 will be described below in detail with reference to FIGS. 2-4. However, it should be understood that the aperture controller 42 may be implemented using any one of: an alternating current (AC) or direct current (DC) electric motor; an AC or DC stepper motor; an AC of DC variable frequency drive; an AC or DC servo motor without a mechanical rotation stop; a pneumatic motor; a hydraulic motor; or a manual crank.

A top end 46 of the ball cartridge 32 is sealed by a threaded top cap 48. In one embodiment, the top cap 48 is provided with a lifting eye 49, and a vent tube 50 that is sealed by a high pressure needle valve 51. The high pressure needle valve 51 is used to vent air from the ball cartridge 32 before a frac job is commenced, using procedures that are well understood in the art. A high pressure seal is provided between the ball cartridge 32 and the top cap 48 by one or more high pressure seals 52. In one embodiment, the high pressure seals 52 are O-rings with backups 54 that are received in one or more circumferential seal grooves 56 in the top end 46 of the ball cartridge 32. In one embodiment, a bottom end 58 of the ball cartridge 32 includes a radial shoulder 60 that supports a threaded nut 62 for connecting the ball drop 30 to a frac head or a high pressure fluid conduit using a threaded union as described in Assignee's U.S. Pat. No. 7,484,776, the specification of which is incorporated herein by reference. As will be understood by those skilled in the art, the bottom end 58 may also terminate in an API (American Petroleum Institute) stud pad or an API flange, both of which are well known in the art.

Movement of the aperture control arm 40 by the aperture controller 42 to drop a frac ball 36 from the ball cartridge 32, or to return to a home position in which the bottom end 38 of the ball rail 34 contacts the inner periphery of the ball cartridge 32, may be remotely controlled by a control console 64. In one embodiment, the control console 64 is a personal computer, though a dedicated control console 64 may also be used. The control console 64 is connected to the aperture controller 42 by a control/power umbilical 66 used to transmit control signals to the aperture controller 42, and receive status information from the aperture controller 42. The control/power umbilical 66 is also used to supply operating power to the aperture controller 42. The control/power umbilical supplies operating power to the aperture controller 42 from an onsite generator or mains power source 67. The aperture controller 42 is mounted to an outer sidewall of the ball cartridge 32 and reciprocates the aperture control arm 40 through a high pressure fluid seal 68. In one embodiment, the high pressure fluid seal 68 is made up of one or more high pressure lip seals, well known in the art. Alternatively, the high pressure fluid seal 68 may be two or more O-rings with backups, Chevron packing, one or more PolyPaks®, or any other high pressure fluid seal capable of ensuring that highly pressurized well stimulation fluid will not leak around the aperture control arm 40.

Figure 2:
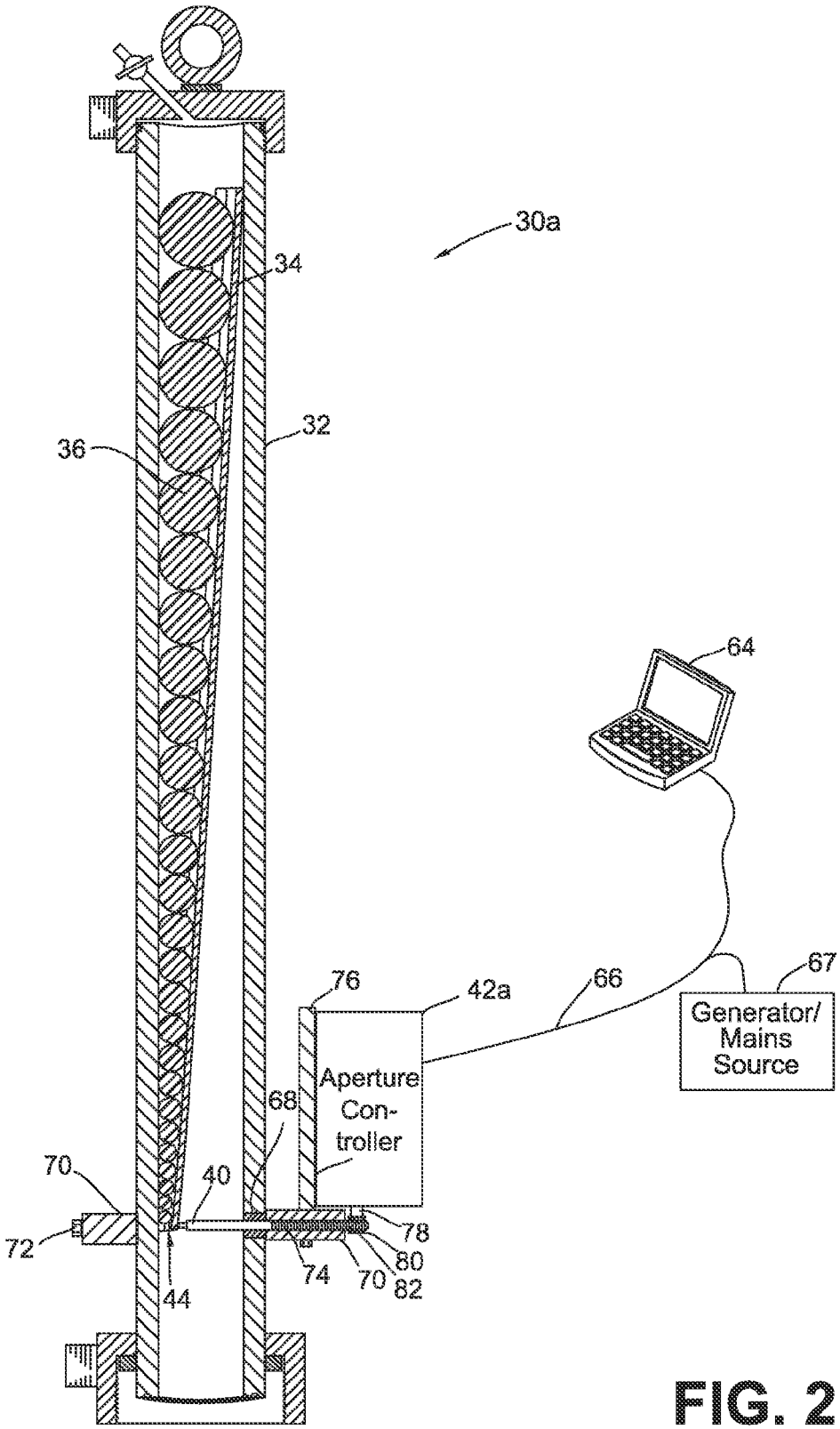
FIG. 2 is a schematic cross-sectional view of another embodiment of the controlled aperture ball drop in accordance with the invention.

FIG. 2 is a schematic cross-sectional view of another embodiment of a controlled aperture ball drop 30*a* in accordance with the invention. In this embodiment, the aperture controller 42*a* is mounted to a radial clamp 70 secured around a periphery of the ball cartridge 32 by, for example, two or more bolts 72. A bore 74 through the radial clamp 70 accommodates the aperture control arm 40. The aperture controller 42*a* is mounted to a support plate 76 that is bolted, welded, or otherwise affixed to the radial clamp 70. The aperture controller 42*a* has a drive shaft 78 with a pinion gear 80 that meshes with a spiral thread 82 on the aperture control arm 40. Rotation of the drive shaft in one direction induces linear movement of the aperture control arm 40 to reduce a size of the ball drop aperture 44, while rotation of the drive shaft 78 in the opposite direction induces linear movement of the aperture control arm 40 in the opposite direction to increase a size of the ball drop aperture 44. The unthreaded end of the aperture control arm 40 is a chrome shaft, which is well known in the art.

Figure 3:
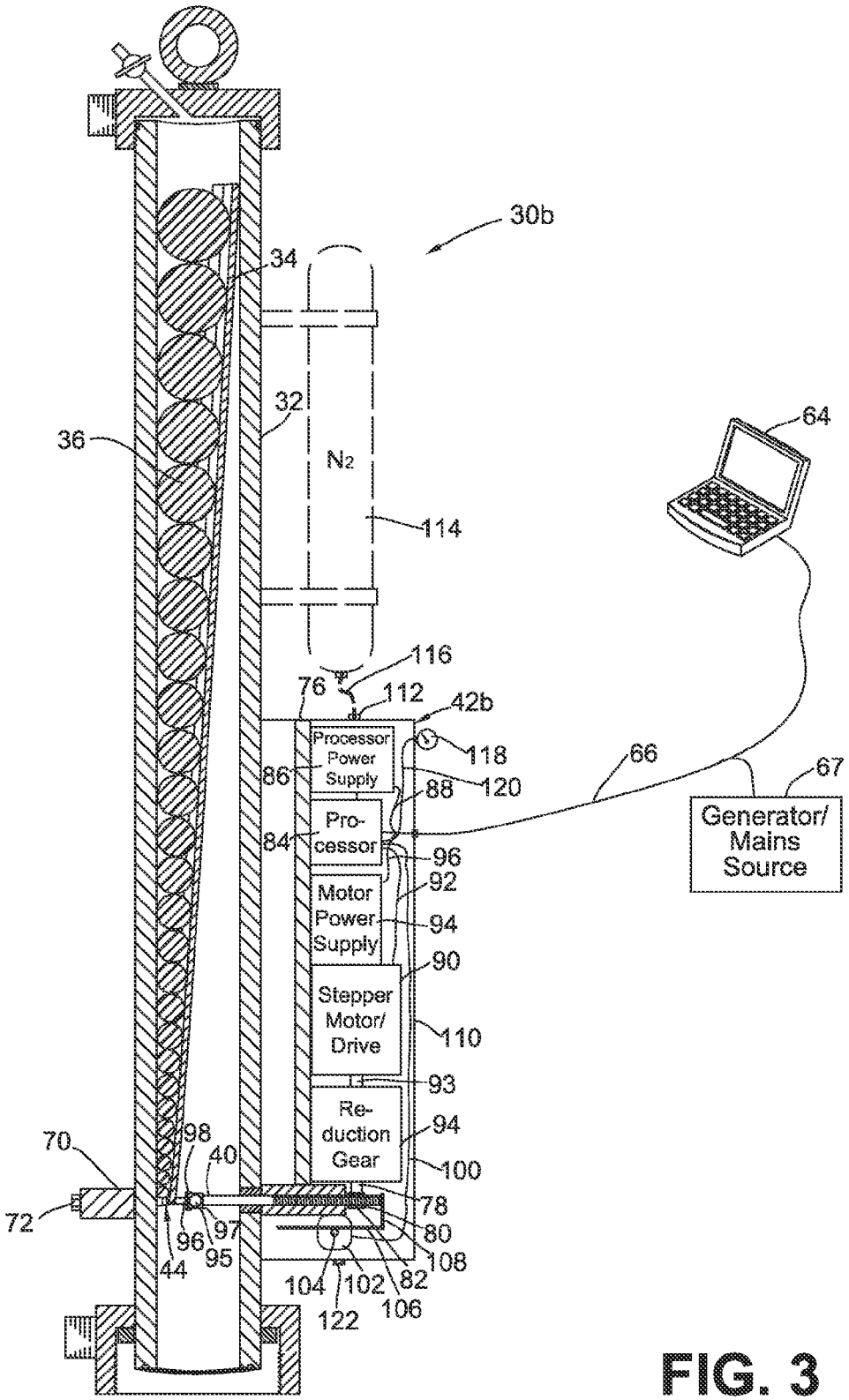
FIG. 3 is a schematic cross-sectional view of one embodiment of the controlled aperture ball drop showing one embodiment of an aperture controller in accordance with the invention.

FIG. 3 is a schematic cross-sectional view of an embodiment of a controlled aperture ball drop 30*b* showing an aperture controller 42*b* in accordance with one embodiment of the invention. In this embodiment, the aperture controller 42*b* has an onboard processor 84 that receives operating power from an onboard processor power supply 86. Electrical power is supplied to the processor power supply 86 by the onsite generator or mains source 67 via an electrical feed 88 incorporated in the control/power umbilical 66. The processor 84 sends a TTL (Transistor-Transistor Logic) pulse for each step to be made by a stepper motor/drive 90, as well as a TTL direction line to indicate a direction of rotation of the step(s), to the stepper motor/drive unit 90 via a control connection 92. The TTL pulses control rotation of the pinion gear 80 in response to commands received from the control console 64. The stepper motor/drive unit 90 is supplied with operating power by a motor power supply that is in turn supplied with electrical power via an electrical feed 96 incorporated into the control/power umbilical 66. In one embodiment, the motor power supply 94 and the stepper motor/drive 90 are integrated in a unit available from Schneider Electric Motion USA as the MDrive®34AC.

An output shaft 93 of the stepper motor/drive 90 is connected to an input of a reduction gear 94 to provide fine control of the linear motion of the control arm 40. The reduction ratio of the reduction gear 94 is dependent on the operating characteristics of the stepper motor/drive 90, and a matter of design choice. The output of the reduction gear 94 is the drive shaft 78 that supports the pinion gear 80 described above. In this embodiment, the aperture control arm 40 is connected to the bottom end of the ball rail 34 by a ball and socket connection. A ball 95 is affixed to a shaft 96 that is welded or otherwise affixed to the bottom end of the ball rail 34. The ball 95 is captured in a socket 97 affixed to an inner end of the aperture control arm 40. A cap 98 is affixed to the open end of the socket 97 to trap the ball 95 in the socket 97. It should be understood that the aperture control arm 40 may be connected to the ball rail 40 using other types of secure connectors know in the art.

An absolute position of the aperture control arm 40 is provided to the processor 84 via a signal line 100 connected to an absolute encoder 102. A pinion affixed to an axle 104 of the absolute encoder 102 is rotated by a rack 106 supported by a plate 108 connected to an outer end of the aperture control arm 40. In one embodiment, the absolute encoder 102 outputs to the processor 84 a 15-bit code word via the signal line 100. The processor 84 translates the 15-bit code word into an absolute position of the aperture control arm 40 with respect to the home position in which the bottom end 38 of the ball rail 34 contacts the inner periphery of the ball cartridge 32.

Since the ball drop 30*b* is designed to operate in an environment where gaseous hydrocarbons may be present, the aperture controller 42*b* is preferably encased in an aperture controller capsule 110. In one embodiment, the capsule 110 is hermetically sealed and charged with an inert gas such as nitrogen gas ($N_2$). The capsule 110 may be charged with inert gas in any one of several ways. In one embodiment, N2 is periodically injected through a port 112 in the capsule 110. In another embodiment, the capsule 110 is charged with inert gas supplied by an inert gas cylinder 114 supported by the ball cartridge 32. A hose 116 connects the inert gas cylinder 114 to the port 112. The capsule 110 may be provided with a bleed port 122 that permits the inert gas to bleed at a controlled rate from the capsule 110. This permits a temperature within the capsule to be controlled when operating in a very hot environment since expansion of the inert gas as it enters the capsule 110 provides a cooling effect. Gas pressure within the capsule 110 may be monitored by the processor 84 using a pressure probe (not shown) and reported to the control console 64. Alternatively, and/or in addition, the internal pressure in the capsule 110 may be displayed by a pressure gauge 118 that measures the capsule pressure directly or displays a digital pressure reading obtained from the processor 84 via a signal line 120.

Figure 4:
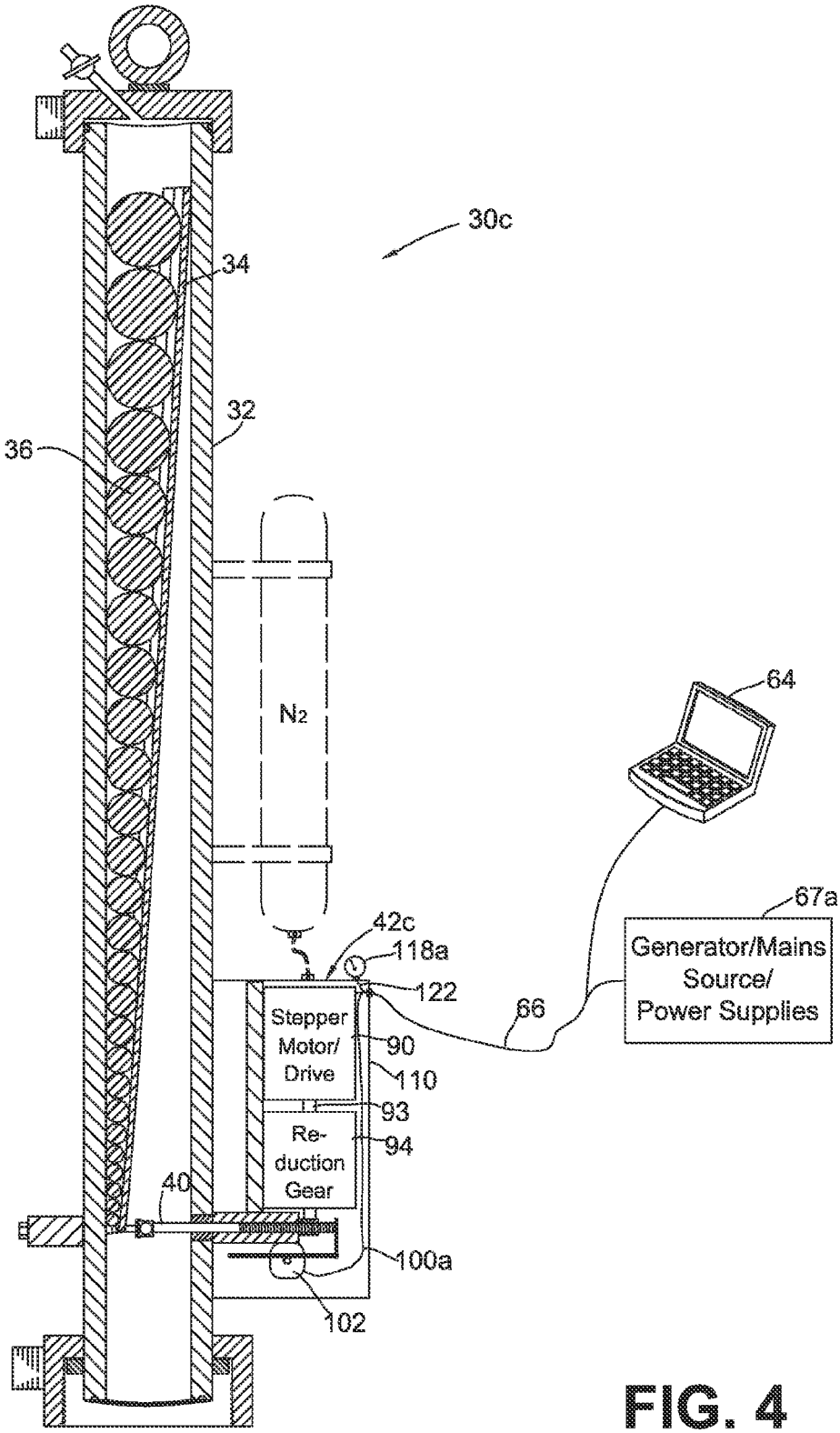
FIG. 4 is a schematic cross-sectional view of yet another embodiment of the controlled aperture ball drop in accordance with the invention.

FIG. 4 is a schematic cross-sectional view of yet another embodiment of a controlled aperture ball drop 30*c* in accordance with the invention. This embodiment is similar to the controlled aperture ball drop 30*b* described above with reference to FIG. 3, except that all control and reckoning functions are performed by the control console 64, and power supply for the stepper motor/drive unit 90 is either integral with the unit 90 or housed with a generator/mains source/power supplies 67*a*. Consequently, the control console 64 sends TTL pulses and TTL direction lines directly via the control/power umbilical 66 to the stepper motor/drive unit 90 of an aperture controller 42*b* to control movement of the aperture control arm 40. An absolute position of the aperture control arm 40 is reported to the control console 64 by the absolute encoder 102 via a signal line 100*a* in the control/power umbilical 66. An internal pressure of the capsule 110 is measured by a pressure sensor 118*a*, and reported to the control console 64 via a signal line 122 incorporated into the control/power umbilical 66. The pressure sensor 118*a* optionally also provides a direct optical display of gas pressure within the capsule 110.

Figure 5:
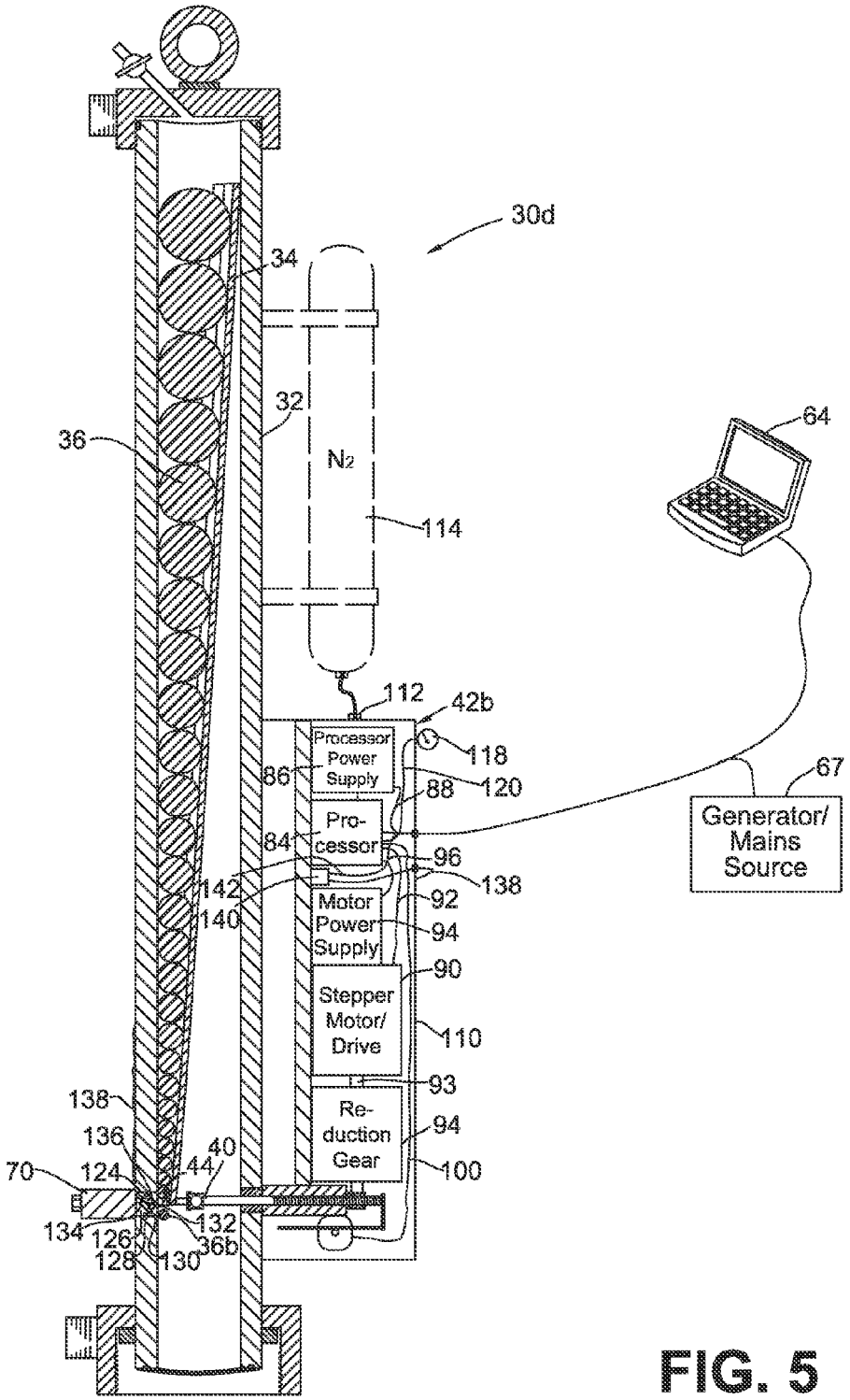
FIG. 5 is a schematic cross-sectional view of a further embodiment of the controlled aperture ball drop in accordance with the invention.

FIG. 5 is a schematic cross-sectional view of a further embodiment of a controlled aperture ball drop 30*d* in accordance with the invention. The ball drop 30*d* is the same as the ball drop 30*b* described above with reference to FIG. 3 except that it further includes an optical detector for detecting each ball dropped by the ball drop 30*d*. In this embodiment, the optical detector is implemented using a port 124 in a sidewall of the ball cartridge 32 opposite the port that accommodates the aperture control arm 40. The port 124 receives a copper beryllium plug 126 that is retained in the port 124 by the radial clamp 70. A high pressure fluid seal is provided by, for example, one or more O-ring seals with backups 128 received in peripheral grooves in the plug 126. An angled, stepped bore 130 in the plug 126 receives a collet 132 with an axial, stepped bore 134. An inner end of the axial stepped bore 134 retains a sapphire window 136. Two optical fibers sheathed in a cable 138 are glued to an inner side of the sapphire window 136 using, for example, an optical grade epoxy. One of the optical fibers emits light generated by a photoelectric sensor 140 housed in the aperture controller capsule 110. In one embodiment, the photoelectric sensor 140 is a Banner Engineering SM312FP. When a ball 36*b* is dropped by the controlled aperture ball drop 30*d*, the light emitted by the one optical fiber is reflected back to the other optical fiber, which transmits the light to the photoelectric sensor 140. The photoelectric sensor 140 generates a signal in response to the reflected light and transmits the signal to the processor 84 via a signal line 142. The processor 84 translates the signal and notifies the control console 64 of the ball drop.

Figure 6:
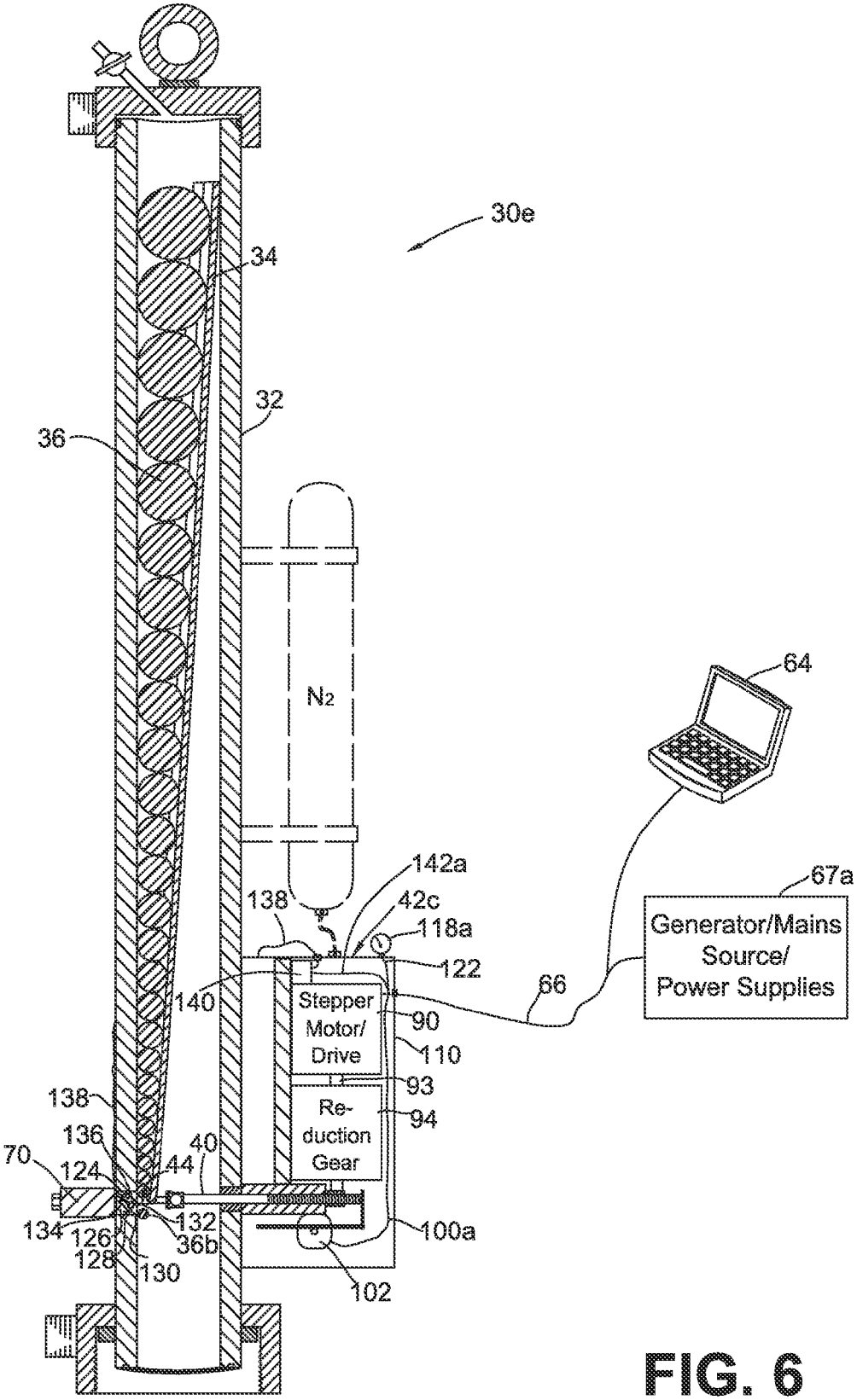
FIG. 6 is a schematic cross-sectional view of yet a further embodiment of the controlled aperture ball drop in accordance with the invention.

FIG. 6 is a schematic cross-sectional view of yet a further embodiment of a controlled aperture ball drop 30*e* in accordance with the invention. This embodiment is the same as the controlled aperture ball drop 30*c* described above with reference to FIG. 4 except that it further includes the photo detector described above with reference to FIG. 5, which will not be redundantly described. In this embodiment, however, the signal generated by the photoelectric sensor 140 is sent via a signal line 142*a* incorporated in the control/power umbilical 66 to the control console 64. The control console 64 processes the signals generated by the photoelectric sensor 140 to confirm a ball drop.

Figure 7:
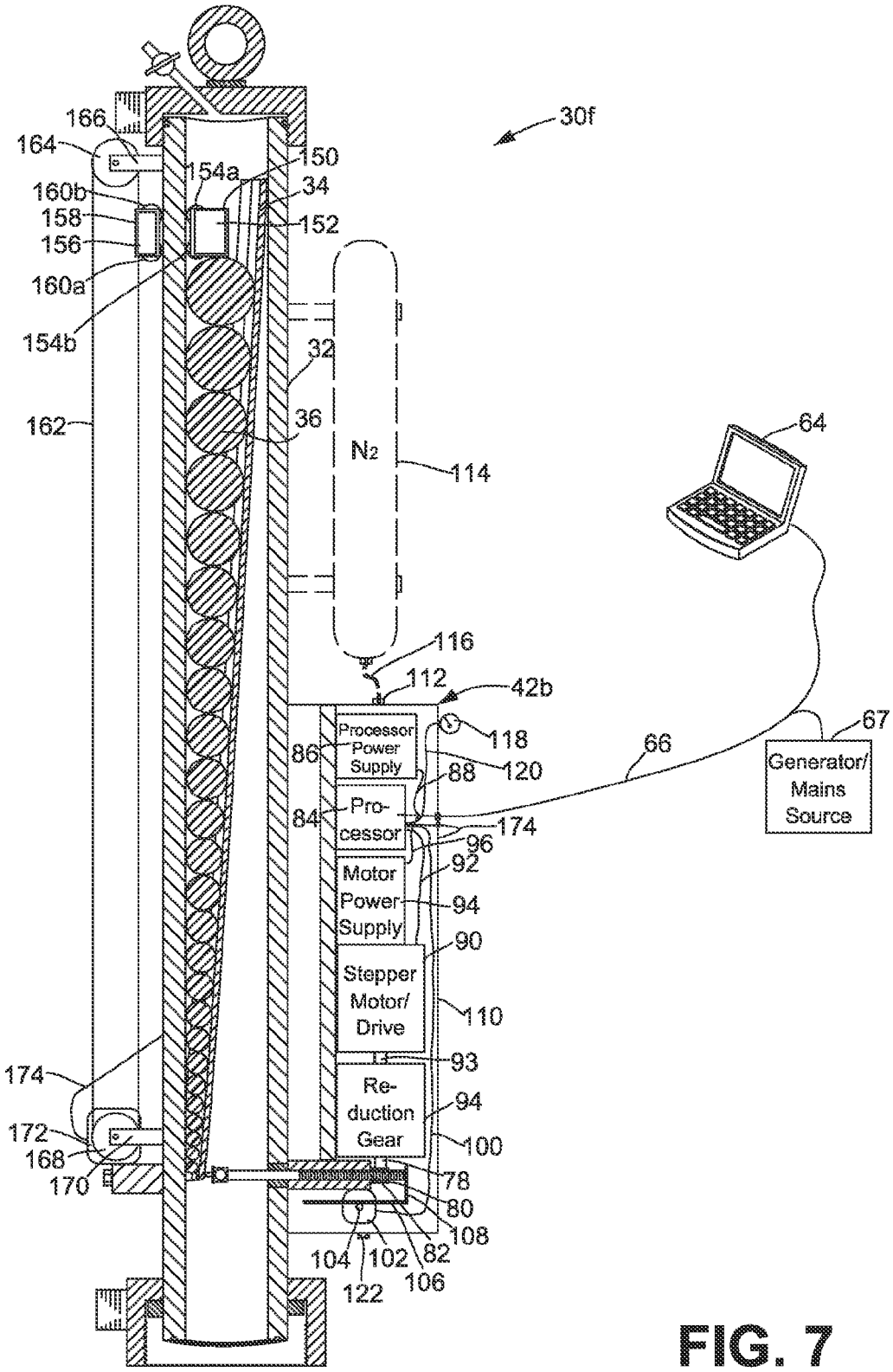
FIG. 7 is a schematic cross-sectional view of still a further embodiment of the controlled aperture ball drop in accordance with the invention.

FIG. 7 is a schematic cross-sectional view of still a further embodiment of a controlled aperture ball drop 30*f* in accordance with the invention. This embodiment is the same as the embodiment described above with reference to FIG. 3 except that it includes a mechanism for tracking a height of the ball stack 36 supported by the ball rail 34, to permit the operator to verify that a frac ball has been dropped when a ball drop command is sent from the control console 64. In this embodiment, a ball stack follower 150 rests on top of the frac ball stack 36. The ball stack follower 150 encases one or more rare earth magnets 152. The ball stack follower 150 has two pairs of wheels 154*a* and 154*b* that space it from the inner periphery of the ball cartridge 32 to reduce friction and ensure that the ball stack follower readily moves downwardly with the ball stack 36 as frac balls are dropped by the ball drop 30*f*. The rare earth magnet(s) 152 strongly attracts oppositely oriented rare earth magnet(s) 156 carried by an external ball stack tracker 158. The ball stack tracker 158 also has two pairs of wheels 160*a* and 160*b* that run over the outer sidewall of the ball cartridge 32. The ball stack tracker 158 is securely affixed to a belt 162 that loops around an upper pulley 164 rotatably supported by an upper bracket 166 affixed to the outer sidewall of the ball cartridge 32 and a lower pulley 168 rotatably supported by a lower bracket 170, likewise affixed to the outer sidewall of the ball cartridge 32. The lower pulley 168 is connected to the input shaft of a potentiometer 172, or the like. Output of the potentiometer 172 is sent via an electrical lead 174 to the processor 84, which translates the output of the potentiometer 172 into a relative position of a top of the ball stack 36. That information is sent via the control/power umbilical 66 to the control console 64, which displays the relative position of the top of the ball stack 36. This permits the operator to verify a ball drop and confirm that only the desired ball has been dropped from the ball stack 36.

As will be understood by those skilled in the art, the mechanism for tracking the height of the ball stack 36 supported by the ball rail 34 can be implemented in many ways aside from the one described above with reference to FIG. 7. For example, a relative position of the ball stack tracker 158 can be determined using a linear potentiometer, a string potentiometer, an absolute or incremental encoder, a laser range finder, a photoelectric array, etc.

Figure 8:
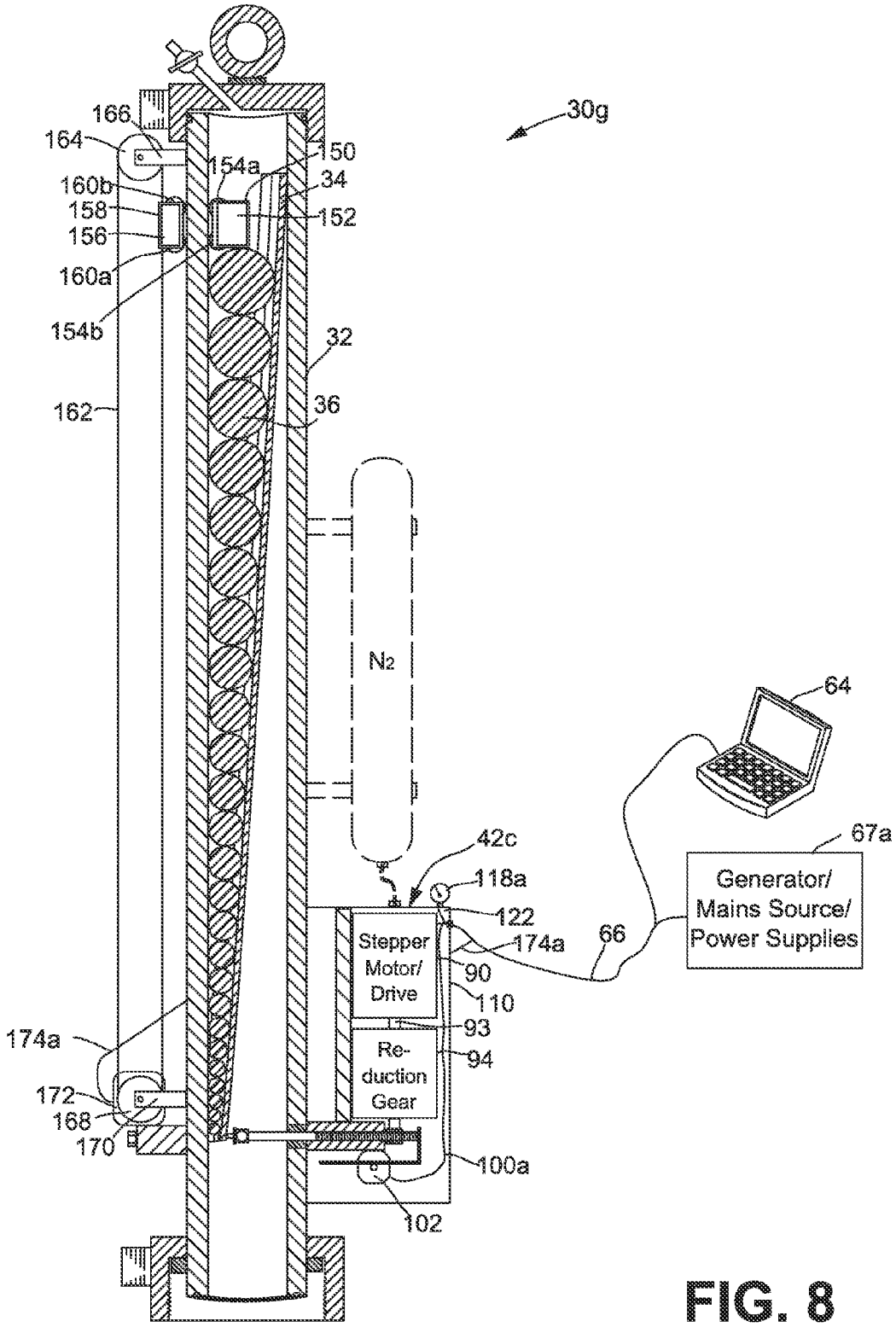
FIG. 8 is a schematic cross-sectional view of another embodiment of the controlled aperture ball drop in accordance with the invention.

FIG. 8 is a schematic cross-sectional view of another embodiment of a controlled aperture ball drop 30*g* in accordance with the invention. The controlled aperture ball drop 30*g* is the same as the controlled aperture ball drop 30*c* described above with reference to FIG. 4 except that it further includes the electro-mechanical ball stack tracking mechanism described above with reference to FIG. 7. In this embodiment, output of the potentiometer 172 is sent via an electrical lead 174*a* incorporated in the control/power umbilical 66 directly to the control console 64. The control console 64 translates the output of the potentiometer 172 into a relative position of a top of the ball stack 36 and displays the relative position of the top of the ball stack 36. This permits the operator to verify a ball drop and confirm that only the desired ball has been dropped from the ball stack 36 after a ball drop command has been sent to the stepper motor/drive 90.

Figure 9:
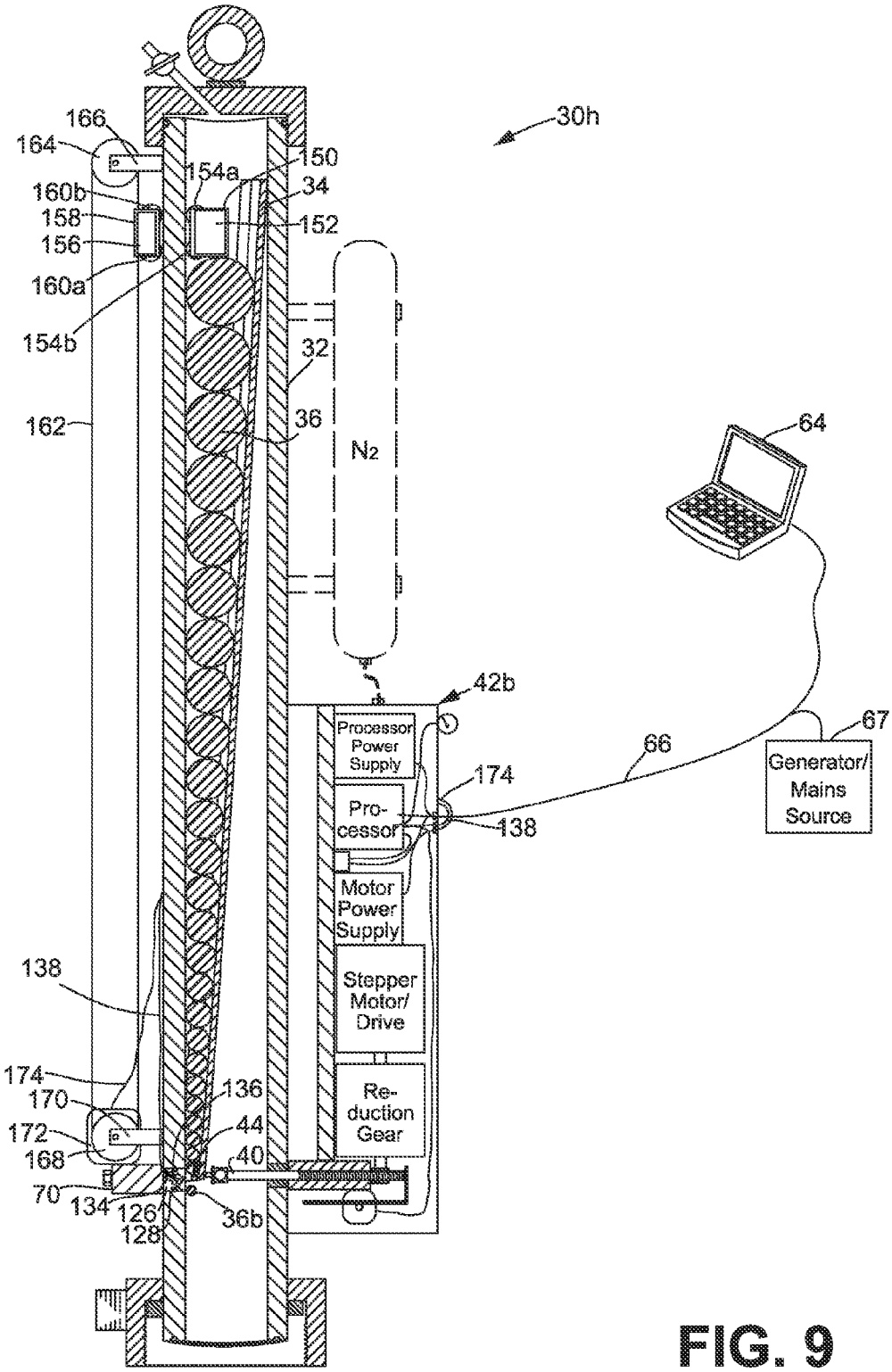
FIG. 9 is a schematic cross-sectional view of yet another embodiment of the controlled aperture ball drop in accordance with the invention.

FIG. 9 is a schematic cross-sectional view of yet another embodiment of a controlled aperture ball drop 30*h* in accordance with the invention. The controlled aperture ball drop 30*h* is the same as the ball drop 30*b* described above with reference to FIG. 3 except that it further includes both the optical detector described above with reference to FIG. 5 and the electro-mechanical ball stack tracking mechanism described above with reference to FIG. 7. The optical detector provides the operator with an indication that a ball has been dropped and the redundant ball stack tracking mechanism verifies that the frac ball stack 36 has moved downwardly by an increment corresponding to a diameter of the frac ball dropped. Of course if either the optical detector or the electro-mechanical ball stack tracking mechanism fails during a well stimulation procedure, the remaining ball drop tracking mechanism is likely to continue to function throughout the procedure so that the operator always has confirmation each time a ball is dropped from the controlled aperture ball drop 30*h*.

Figure 10:
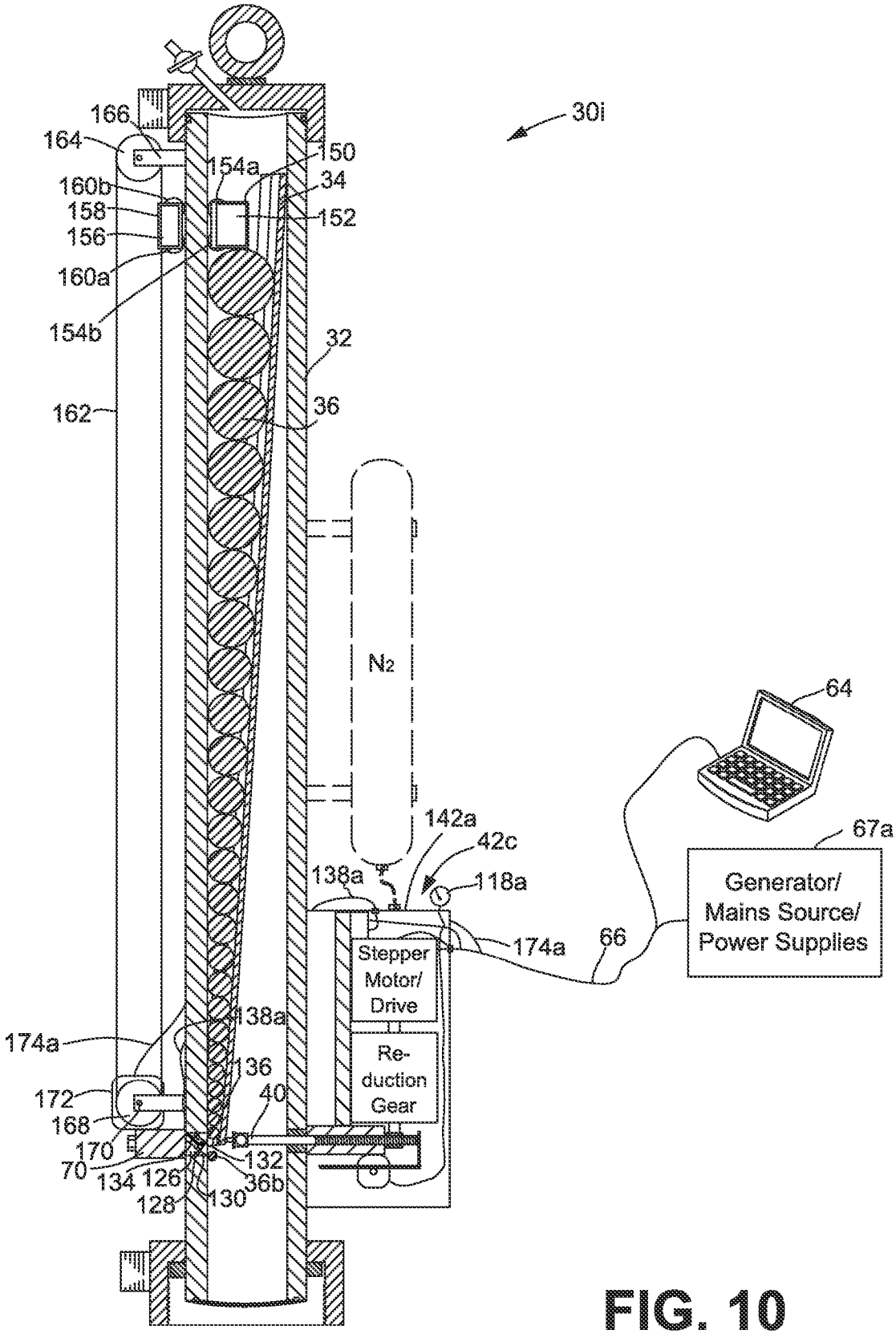
FIG. 10 is a schematic cross-sectional view of yet a further embodiment of the controlled aperture ball drop in accordance with the invention.

FIG. 10 is a schematic cross-sectional view of yet a further embodiment of a controlled aperture ball drop 30*i* in accordance with the invention. The controlled aperture ball drop 30*i* is the same as the ball drop 30*c* described above with reference to FIG. 4 except that it further includes both the optical detector described above with reference to FIGS. 5 and 6, and the electro-mechanical ball stack tracking mechanism described above with reference to FIGS. 7 and 8. As explained above, the optical detector provides the operator with an indication that a ball has been dropped and the redundant ball stack tracking mechanism verifies that the frac ball stack 36 has moved downwardly by an increment corresponding to a diameter of the frac ball dropped. As further explained above, if either the optical detector or the electro-mechanical ball stack tracking mechanism fails during a well stimulation procedure, the remaining ball drop tracking mechanism is likely to continue to function throughout the procedure so that the operator always has confirmation each time a ball is dropped from the controlled aperture ball drop 30*i*.

FIG. 11 is a side elevational view of one embodiment of the ball rail 34 for the embodiments of the controlled aperture ball drop 30*i* shown in FIGS. 1-10, and FIG. 12 is a schematic cross-sectional view of the ball rail shown in FIG. 11, taken along line 12-12 of FIG. 11. In this embodiment, the ball rail 34 is substantially V-shaped in cross-section and constructed of 5 layers (200*a*-200*e*) of 14 gauge stainless steel welded together at longitudinally spaced intervals (202*a*-202*j*) along opposite side edges. The ball rail 34 is longitudinally curved to substantially conform to a curvature of the ball stack 36 intended to be dropped when the ball stack 36 is vertically aligned along the inner periphery of the ball cartridge 32. However, the cross-sectional shape of the ball rail 34 is the same along the length of the ball rail, except at the bottom end 38 where a portion of the top edges of some of the laminations are ground or cut away at 204 to allow the V at the bottom end to approach the inner periphery of the ball cartridge 32 close enough to trap the smallest ball in the ball stack 36 to be dropped, e.g. a bit less than ¾" (1.905 cm).

FIG. 13 is a table showing a deflection of the ball rail 34 shown in FIG. 11 at points A, B and C under a 10 lb. (4.54 kg) mass at three spaced apart positions relative to the bottom end 38 of the ball rail 34. As can be seen, the ball rail is quite stiff, which is a condition required to support the ball stack 36 in vertical alignment against the inner periphery of the ball cartridge 36. In general, it has been observed that this degree of stiffness of the ball rail 34 is adequate to provide a functional ball rail 34.

Figure 14:
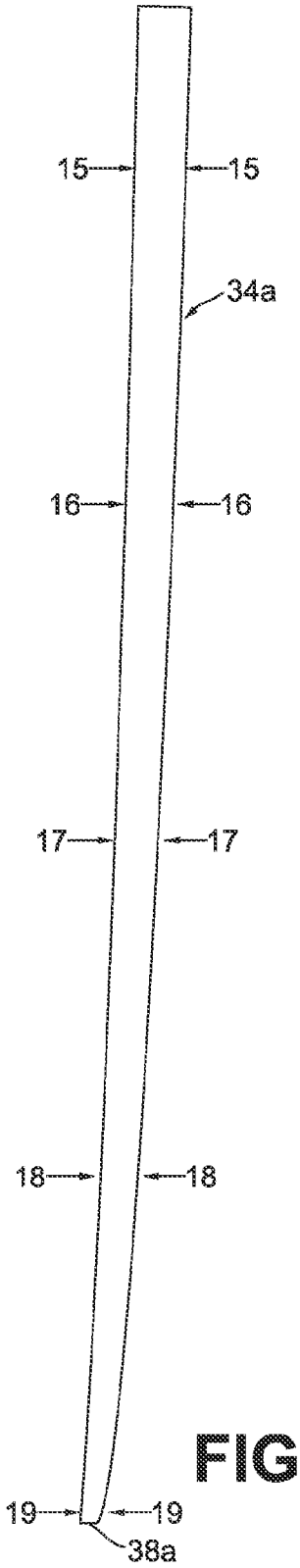
FIG. 14 is a side elevational view of another embodiment of a ball rail for the embodiments of the invention shown in FIGS. 1-10.
Figure 15:
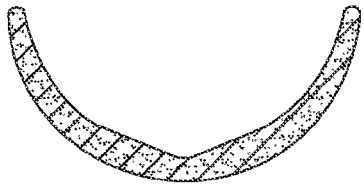
FIGS. 15-19 are schematic cross-sectional views of the ball rail shown in FIG. 14, respectively taken along lines 15-15, 16-16, 17-17, 18-18 and 19-19 of FIG. 14.
Figure 16:
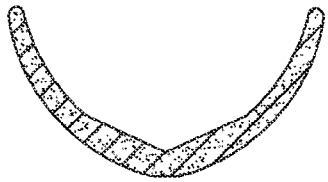
Figure 17:
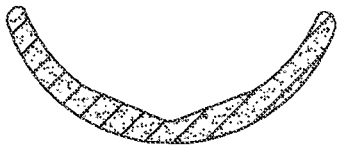
Figure 18:
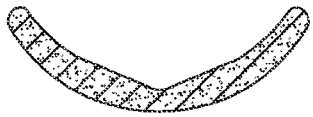
Figure 19:
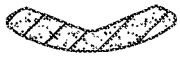

FIG. 14 is a side elevational view of another embodiment of a ball rail 34*a* for the embodiments of the controlled aperture ball drops 30-30*i* shown in FIGS. 1-10, and FIGS. 15-19 are schematic cross-sectional views of the ball rail 34*a* shown in FIG. 14, respectively taken at lines 15-15, 16-16, 17-17, 18-18 and 19-19 of FIG. 14. In this embodiment, the ball rail 34*a* is constructed of a carbon fiber composite, which is known in the art. The ball rail 34*a* is longitudinally curved to substantially conform to the curvature of the ball stack 36 when the ball stack 36 is vertically aligned along the inner periphery of the ball cartridge 32. The cross-sectional shape is substantially constant from the top end to the bottom 38*a* of the ball rail 34*a*. However, a height of the side edges decreases from top to bottom to ensure that 8-10 of the smallest diameter frac balls to be dropped are maintained in a vertical alignment in the ball cartridge 32.

Although these two examples of a ball rail 34 and 34*a* have been described in detail, it should be noted that the ball rail 34 can be machined from solid bar stock; cut from round, square, hexagonal or octagonal tubular stock; or laid up using composite material construction techniques that are known in the art. It should be further noted that there appears to be no upper limit to the stiffness of the rail provided the rail is not brittle.

The embodiments of the invention described above are only intended to be exemplary of the controlled aperture ball drop 30*a*-30*i* in accordance with the invention, and not a complete description of every possible configuration. The scope of the invention is therefore intended to be limited solely by the scope of the appended claims.

We claim:

1. A controlled aperture ball drop, comprising:

a ball cartridge having a sealed top end and a bottom end adapted to the connected to a frac head or a high pressure fluid conduit;

a ball rail within the ball cartridge, the ball rail having a bottom end that forms an aperture with an inner periphery of the ball cartridge and supports a frac ball stack arranged in a predetermined size sequence against the inner periphery of the ball cartridge above the aperture; and an aperture controller operatively connected to the ball rail in the ball cartridge, the aperture controller controlling a size of the aperture to sequentially release frac balls from the frac ball stack.

2. The controlled aperture ball drop as claimed in claim 1 further comprising a control console connected to the aperture controller, the control console receiving operator input to send a ball drop command to the aperture controller to drop a frac ball from the frac ball stack.

3. The controlled aperture ball drop as claimed in claim 2 further comprising a control umbilical that connects the control console to the aperture controller.

4. The controlled aperture ball drop as claimed in claim 1 further comprising an aperture control arm that connects the aperture controller to the ball rail.

5. The controlled aperture ball drop as claimed in claim 4 wherein the aperture control arm is connected to a bottom end of the ball rail.

6. The controlled aperture ball drop as claimed in claim 4 further comprising an absolute encoder connected to the aperture control arm to provide a relative position of the aperture control arm with respect to a home position in which a bottom end of the ball rail contacts an inner periphery of the ball cartridge.

7. The controlled aperture ball drop as claimed in claim 1 further comprising an optical detector that detects each ball dropped from the frac ball stack.

8. The controlled aperture ball drop as claimed in claim 1 further comprising a mechanism that tracks a height of the frac ball stack in the ball cartridge.

9. The controlled aperture ball drop as claimed in claim 8 wherein the mechanism that tracks a height of the frac ball stack comprises:

a ball stack follower inside the ball cartridge that rests on a top one of the frac balls in the frac ball stack and is adapted to move with the top one of the frac balls until the top one of the frac balls is dropped through the aperture, the frac ball follower comprising at least one magnet;

a ball stack tracker adapted to move along an outside surface of the ball cartridge as the ball stack follower moves with the top ball, the ball stack tracker comprising at least one magnet that is strongly attracted to the at least one magnet of the ball stack follower; and a mechanism that tracks a relative position of the ball stack tracker with respect to the aperture.

10. A controlled aperture ball drop, comprising:

a ball rail within a ball cartridge, the ball rail having a bottom end that forms an aperture with an inner periphery of the ball cartridge and supports a frac ball stack arranged in a predetermined size sequence against the inner periphery of the ball cartridge above the aperture; and an aperture controller operatively connected to the ball rail, the aperture controller controlling a size of the aperture to sequentially drop frac balls in sequence from the frac ball stack.

11. The controlled aperture ball drop as claimed in claim 10 wherein the ball cartridge comprises a threaded top cap with a vent tube sealed by a high pressure valve and a bottom end adapted to be mounted to a frac head or a high pressure fluid conduit.

12. The controlled aperture ball drop as claimed in claim 10 further comprising an aperture control arm that connects the aperture controller to a bottom end of the ball rail.

13. The controlled aperture ball drop as claimed in claim 12 further comprising a radial clamp that encircles the ball cartridge and supports the aperture controller, the radial clamp comprising a bore through which the aperture control arm reciprocates.

14. The controlled aperture ball drop as claimed in claim 10 wherein the aperture controller comprises an electric motor and a processor that controls the electric motor.

15. The controlled aperture ball drop as claimed in claim 14 further comprising a control console that sends ball drop commands to the processor.

16. The controlled aperture ball drop as claimed in claim 10 further comprising at least one mechanism that detects the drop of a frac ball through the aperture.

17. A controlled aperture ball drop, comprising a ball rail supported within a ball cartridge that is adapted to be mounted to a frac head or a high pressure fluid conduit, a bottom end of the ball rail forming an aperture with an inner periphery of the ball cartridge through which frac balls of a frac ball stack arranged in a predetermined size sequence supported by the ball rail are sequentially dropped as a size of the aperture is increased by an aperture controller operatively connected to the ball rail.

18. The controlled aperture ball drop as claimed in claim 17 wherein the aperture controller comprises a motor and a processor that controls the motor.

19. The controlled aperture ball drop as claimed in claim 18 further comprising a control console connected to the processor by a control umbilical.

20. The controlled aperture ball drop as claimed in claim 18 further comprising a mechanism for detecting a ball drop through the aperture.

* * * * *